United States Patent [19]

Dolgin

[11] Patent Number: 4,762,677

[45] Date of Patent: Aug. 9, 1988

[54] METHOD OF PREPARING A BULK AMORPHOUS METAL ARTICLE

[75] Inventor: Benjamin P. Dolgin, Glenview, Ill.

[73] Assignee: Allied-Signal Inc., Morristown, N.J.

[21] Appl. No.: 116,599

[22] Filed: Nov. 3, 1987

[51] Int. Cl.[4] ..... B22F 3/24

[52] U.S. Cl. ..... 419/11; 419/10; 419/28; 419/29; 419/45; 419/46

[58] Field of Search ..... 419/10, 29, 11, 45, 419/28, 46

[56] References Cited

U.S. PATENT DOCUMENTS

| | | | |
|---|---|---|---|
| 4,537,624 | 8/1985 | Tenhover et al. | 75/0.5 B |
| 4,537,625 | 8/1985 | Tenhover et al. | 75/0.5 A |
| 4,557,766 | 12/1985 | Tenhover et al. | 148/11.5 P |
| 4,594,104 | 6/1986 | Reybould | 75/243 |
| 4,624,705 | 11/1986 | Jatkan et al. | 419/33 |
| 4,640,816 | 2/1987 | Atzmon et al. | 419/33 |
| 4,710,236 | 12/1987 | Schultz | 419/33 |

OTHER PUBLICATIONS

C. C. Koch et al., *Appl. Phys. Lett.*, 43, 1017 (1983).

P. S. Gilman and J. S. Benjamin, "Mechanical Alloying:, *Ann. Rev. Mater. Sci.*, vol. 13, 279–300 (1983).

B. P. Dolgin, M. A. Vanek, T. McGory and D. J. Ham, *J. of Non Crystalline Solids*, 87, 281–289 (1986).

B. P. Dolgin, *Mat. Res. Soc. Symp.*, vol. 80, 69 (1987).

*Primary Examiner*—Stephen J. Lechert, Jr.

*Attorney, Agent, or Firm*—Thomas K. McBride; Eugene I. Snyder; Frank S. Molinaro

[57] ABSTRACT

This invention deals with a method of producing a bulk amorphous metal alloy article. The method involves mechanically alloying an amorphous matrix material and a crystalline element which is a fast diffuser in the matrix material to give a powder mixture which is at least 50% but less than 100% amorphous. This powder mixture is then formed into a bulk amorphous metal alloy article by ordinary forming methods such as hot-pressing. The resultant bulk amorphous metal alloy article can be heated above its glass transition temperature to provide a bulk crystalline metal alloy article.

11 Claims, No Drawings

METHOD OF PREPARING A BULK AMORPHOUS METAL ARTICLE

BACKGROUND OF THE INVENTION

A number of crystalline metal alloy materials are generally brittle and hard to machine. Examples of such materials are metal alloys which are permanent magnets. Because of the hardness and brittleness of these materials, the machining of these materials into small magnets which can be fitted into magnetic circuits is very expensive. Therefore, a need exists for a more economical method of forming magnetic material into a desired shape.

The instant invention cures this problem by preparing a bulk amorphous metal article which is easily machinable and which can be recrystallized to give the appropriate magnetic material. Amorphous materials are well known in the art and are produced in a number of ways. One such method disclosed in U.S. Pat. Nos. 4,537,624 and 4,537,625 involves the thermal or chemical decomposition of a precursor compound to give an amorphous material. Another method of forming an amorphous material is through the rapid quenching ($10^6$° C./second) of a molten material. See, for example, U.S. Pat. No. 4,594,104 and references therein. A further method of producing an amorphous material is through mechanical alloying. See C.C. Koch et al, *Appl. Phys. Let.*, 43, 1017 (1983). Mechanical alloying is a physical process which takes place during high energy ball milling. More specifically, mechanical alloying is characterized by the repeated welding, fracturing and rewelding of powder particles. Mechanical alloying can produce an amorphous powder. For a more detailed explanation, see P.S. Gilman and J.S. Benjamin, "Mechanical Alloying", *Ann. Rev. Mater. Sci.*, Vol. 13, 279–300 (1983).

These amorphous materials usually cannot be formed into a bulk amorphous metal alloy article by ordinary forming (i.e. ordinary with respect to crystalline material) methods such as cold or hot-pressing. A bulk or consolidated article is an article which has high strength (not easily deformed), integrity, hardness, etc. However, some of these amorphous materials can be formed into a bulk amorphous metal alloy article by more severe methods such as high speed compaction. For a description of the high speed compaction process, see U.S. Pat. No. 4,594,104. Examples which fall into the latter category include NiTi, SmCo, NiZr, NiHf, and CuZr.

The prior art additionally discloses two specialized methods of forming bulk amorphous metal alloy articles. First, U.S. Pat. No. 4,557,766 discloses that an intimate mixture (which is crystalline) of the components of the metal alloy is formed by chemically reducing compounds of the desired components. This intimate mixture can be formed into a bulk amorphous metal alloy article by standard methods such as hot-pressing and then heated to induce the amorphous state. Second, U.S. Pat. No. 4,640,816 discloses a method of cold-working the precursors into a thin sheet or film and then heating the sheet to induce the amorphous state. It is also necessary that one of the precursors be in the form of a film, foil, sheet, etc. Thus, this method gives very limited shapes of the amorphous metal alloy.

In marked contrast to the prior art, the present invention provides a simple method of forming a bulk amorphous metal alloy article from an amorphous matrix material and at least one element which is a fast diffuser in the amorphous matrix material (hereinafter fast diffuser element). Unlike the methods of the prior art such as those in U.S. Pat. No. 4,594,104 which uses an elaborate system to precipitate an intimate mixture of the components of the metal alloy, the present invention starts with an amorphous matrix material and a crystalline fast diffuser element, in the form of powders, flakes, etc., which are mechanically alloyed into a substantially amorphous intimate powder mixture. By substantially amorphous is meant that the powder mixture is at least 50% but less than 100% amorphous.

The prior art does not disclose nor suggest that it would be advantageous to mechanically alloy an amorphous matrix material and a crystalline fast diffuser element to a point that some degree of crystallinity remains in the resultant powder mixture. It is applicant who has surprisingly discovered that the presence of a crystalline component in a mechanically alloyed powder mixture allows one to form bulk amorphous metal alloy articles using standard forming methods such as cold-rolling or hot-pressing. Applicant has also discovered, absent any teaching in the prior art, that in order to form bulk amorphous metal alloy articles, each particle of the powder mixture must have a modulated structure. By modulated structure is meant a concentration gradient of the respective components of the particle.

In summary, this invention provides a simple method of forming a bulk amorphous metal alloy article by routine methods such as cold or hot-pressing. This presents a significant advance in the art by forming bulk amorphous metal alloy articles without resorting to such costly and shape-limited methods as high speed compaction.

SUMMARY OF THE INVENTION

It is a broad objective of this invention to provide a method of producing a bulk amorphous metal article comprising: (a) mechanically alloying an amorphous matrix material containing at least one metal and at least one crystalline element which is a fast diffuser in the amorphous matrix material to give a powder mixture which is at least 50% but less than 100% amorphous; and (b) forming the powder mixture into a bulk amorphous metal alloy article, having a density of at least 80% of its theoretical density, at a pressure greater than 5,000 atmospheres and a temperature from about 25° C. to below the glass transition temperature of the powder mixture, and recovering the bulk amorphous metal alloy article.

It is another object of this invention to subsequently heat treat the bulk amorphous metal alloy article at a temperature above the forming temperature of step (b) above, but below the glass transition temperature of the bulk amorphous metal alloy article, thereby relieving any residual stress and any concentration gradients.

It is a further object of this invention to subsequently heat treat said bulk amorphous metal alloy article at a temperature above the glass transition temperature for a time sufficient to provide a bulk crystalline metal alloy article.

Other objects and embodiments of this invention will become apparent in the following detailed description of the invention.

DETAILED DESCRIPTION OF THE INVENTION

As heretofore stated, this invention relates to a method of producing a bulk amorphous metal alloy article and a bulk crystalline metal alloy article. The use of the phrase "amorphous metal alloy" herein refers to an amorphous metal-containing alloy that may also contain non-metallic elements. Illustrative of the non-metallic elements are boron, carbon, silicon, etc. One feature of the invention is the use of mechanical alloying to produce a powder which is an intimate mixture of the components of the metal alloy. The powder consists of particles having a modulated structure and said powder being at least 50% amorphous but less than 100% amorphous. These properties allow the powder mixture to be formed into a bulk amorphous metal alloy article using standard forming techniques such as hot-pressing.

Accordingly, one necessary component of the present invention is an amorphous matrix material. This amorphous matrix material contains at least one metal. In one particular embodiment, the matrix material may comprise at least two metals, at least one of which may be selected from the group including but not limited to scandium, yttrium, titanium, zirconium, hafnium, vanadium, niobium, tantalum, the lanthanides and the actinides. Additionally, at least one metal may be selected from the group including but not limited to vanadium, chromium, manganese, iron, cobalt, nickel, copper, zinc, and gold.

Alternatively, the amorphous matrix material may comprise at least one metal selected from the group including but not limited to scandium, yttrium, titanium, zirconium, hafnium, niobium, tantalum, the lanthanides, the actinides, vanadium, chromium, manganese, iron, cobalt, nickel, copper, zinc and gold and a dopant or modifier. The dopant or modifier is added to enhance vitrification. These dopants can favorably alter the properties of the metal(s) such as electrical conductivity, glass transition temperature, hardness, etc. which facilitates the forming process. Illustrative of elements which can be used as dopants are boron, carbon, and silicon.

Any process known in the art which produces the amorphous state can be used to prepare the amorphous matrix material. Illustrative of these processes are mechanical alloying, rapid solidification, chemical reduction, and vapor deposition. For example, if mechanical alloying is the desired process, it may be carried out as follows. As stated above, mechanical alloying is a physical process which produces metal powders with controlled microstructures by the repeated welding, fracturing, and rewelding of powder particles. One way to achieve mechanical alloying is through the use of a high energy mill. Examples of high energy mills are Szegvari attritor grinding mills and vibratory mills, e.g. Spex Shaker Mill which is manufactured by the Spex Co. For further details, the reader is referred to: P.S. Gilman and J.S. Benjamin, "Mechanical Alloying", *Ann. Rev. Mater. Sci.*, Vol. 13, 279–300 (1983).

Thus, using a Spex mill as an example, the appropriate amounts of the desired crystalline metals or metals plus dopant are placed in a stainless steel grinding vial containing steel balls. The metals and dopants may be used in any particulate form such as flakes, powders, granules, etc. The ratio of the metals or metals and dopants will depend on the desired final composition. Generally, the bulk amorphous metal alloy article will have the formula $A_{1-x}B_x$, where A is at least one matrix material, B is at least one fast diffuser element, and x ranges from about 0.1 to about 0.9. Included in this formulation are binary, ternary, and higher order amorphous metal alloys. For example, if the bulk amorphous article is to have a formula AB and is a binary alloy, then the amorphous matrix material (a) may have the formula $AB_{0.5}$. This means that in preparing the amorphous matrix material the atomic ratio of A:B is 1:0.5 or 2:1.

The amount of steel balls that is placed in the vial with the metals or metals plus dopant will vary but it is preferred that the weight ratio of steel balls to total powder (or flakes or granules) be from about 1:3 to about 10:1. The grinding can be carried out with the dry materials or a lubricant may be added. The lubricant reduces welding of powder particles together and minimizes adherence of the fine powder which is formed to the walls of the vial. If a lubricant is used, it may be chosen from the group including but not limited to alkyl or aryl hydrocarbons. Examples of these lubricants are toluene, hexane, pentane, xylene, etc. The amount of lubricant to be used varies but is usually in the range of about 1 to about 25 weight percent of the total weight of material to be mechanically alloyed.

The amount of time required to produce an amorphous matrix material which is 100% amorphous by mechanical alloying depends on the metals and/or dopants, the presence of a lubricant, and the weight ratio of balls to powder. Therefore, depending on these parameters, a grinding time in the range of 15 minutes to about 500 hours is sufficient to produce an amorphous matrix material. The phase change from crystalline to amorphous can be monitored by X-ray diffraction analysis. The entire mechanical alloying process may be carried out in air but in certain situations where either the crystalline metals or the resultant amorphous matrix materials are highly reactive with air or even pyrophoric, the mechanical alloying process must be done under a non-oxidizing atmosphere such as nitrogen or argon.

A second necessary component of the present invention is at least one crystalline element which is a fast diffuser in the amorphous matrix material. By fast diffuser is meant an element which is capable of diffusing into the matrix material at a rate greater than 2 or more orders of magnitude than the self-diffusion rate of the matrix metal. Examples of elements which are fast diffusers in the matrix materials named above include but are not limited to vanadium, chromium, manganese, iron, cobalt, nickel, copper, zinc, boron, carbon, silicon, and gold. Again, these elements can be used in any particulate form such as flakes, powders, granules, etc.

The amorphous matrix material and the fast diffuser element are now mechanically alloyed to give a powder mixture which is substantially amorphous, i.e. at least 50% but less than 100% amorphous. It is necessary and critical that mechanical alloying be stopped before the powder mixture becomes 100% amorphous. It has been determined that the powder mixture must be partly crystalline in order for the powder mixture to be formed into a bulk amorphous metal alloy article by simple forming methods such as hot-pressing. If the powder mixture is 100% amorphous, then severe forming methods such as high speed compaction must be used to form a bulk amorphous metal alloy article. An additional necessary feature of the substantially amorphous powder mixture produced by mechanical alloying is that each particle of the powder have a modulated structure.

By modulated structure is meant that there exists a concentration gradient of the matrix material and fast diffuser element(s) within each particle.

Mechanical alloying of the amorphous matrix material and fast diffuser element is carried out as described above. Specifically, it is desirable to mechanically alloy the amorphous matrix material and fast diffuser element for a time from about 15 minutes to about 500 hours. Also the ratio of amorphous matrix material to fast diffuser element is the same as that of the final bulk amorphous metal alloy article. Thus, if the formula of the bulk amorphous metal alloy article is AB, then the ratio of A (amorphous matrix material) to B (fast diffuser element) is 1:1.

Once the substantially amorphous powder mixture is formed by mechanical alloying and has the requisite modulated structure, it can be formed into a bulk amorphous metal alloy article. This step can be accomplished by a number of known processes such as extrusion, hot pressing and hot-rolling. The use of standard metal forming processes is one of the advantages of the present invention. The advantage of using standard processes such as extrusion, hot pressing, etc. is that various article shapes can be obtained using these processes whereas the types of shapes which can be obtained using methods such as high speed compaction are very limited. An additional advantage to the present invention is that the desired article can be formed in the receptacle of the bulk article. For example, the holding magnets for a stepping motor can be formed in situ by packing the slots which hold the magnets with the desired amorphous powder and forming in place. Similarly, the cutting edge of a metal cutting tool can be formed in situ.

One condition which is necessary to form a bulk amorphous metal alloy article from a substantially amorphous powder mixture is a pressure sufficient to drive the powder particles together. The minimum amount of pressure required to drive the particles together can vary considerably depending on the desired components of the powder mixture, but usually a pressure greater than 5,000 atmospheres is sufficient. When such pressures are applied, diffusion of the fast diffuser element into the matrix metal occurs. This diffusion occurs at room temperature, but usually the rate is slow. Therefore, for convenience, the temperature is raised to increase the diffusion rate of the fast diffuser element into the matrix metal. However, the temperature must be below the glass transition temperature so that crystallization does not occur before diffusion has occurred. Thus, it is convenient to heat the matrix material and the fast diffuser element from about 25° C. to below the glass transition temperature of the powder mixture (Tg), and preferably from about 25° C. to below 0.9 Tg. For example, the glass transition temperature for NiTi is approximately 510° C., for CoTi it is approximately 500° C., and for FeTi it is approximately 490° C. The resultant bulk amorphous metal alloy article can be machined using standard metal machining tools into whatever shape is desired.

Once consolidation has occurred, it is desirable to heat treat the bulk amorphous metal alloy article in order to ensure that diffusion has been completed, relieve any stress, and eliminate any concentration gradients. This heat treatment is normally carried out at a temperature higher than the forming temperature but less than the glass transition temperature, and should be carried out for about 30 to about 300 minutes. The bulk amorphous metal alloy articles produced by the instant invention can be used in a variety of applications such as low temperature welding alloys, magnetic bubble memories, high field conducting devices, soft magnetic materials for power transformer cores, etc.

Additionally, the bulk amorphous metal alloy article that has been formed into the desired shape can be further processed to provide a bulk crystalline metal alloy article. This is accomplished by heating the bulk amorphous metal alloy article above its glass transition temperature. Although crystallization occurs almost instantaneously, it is important to heat the bulk amorphous metal alloy article at said temperature for a period of time of about 5 minutes to about 5 hours. This ensures that extensive grain growth has occurred and increases the hardness and toughness of the bulk crystalline metal alloy article. Thus, for example, if a CoTi bulk crystalline metal alloy article is desired, heating a CoTi bulk amorphous metal alloy article at 600° C. for about 1 hour produces a bulk crystalline metal alloy article. These bulk crystalline metal alloy articles have a variety of applications including stepping motor magnets, cutting edge of metal cutting tools, etc.

In order to more fully illustrate the advantages to be derived from the instant invention, the following examples are provided. It is to be understood that the examples are by way of illustration only and are not intended as an undue limitation on the broad scope of the invention as set forth in the appended claims.

EXAMPLE I

A bulk NiTi amorphous metal alloy article was prepared as follows. First, a $NiTi_2$ amorphous matrix material was prepared by placing 6.883 grams of 99.6% nickel powder, 11.234 grams of 99.9% titanium powder, and 5 ml of toluene in a stainless steel grinding vial with 75 g of stainless steel balls having a diameter of 12 mm. The nickel powder had particles smaller than 325 mesh (44 microns) while the titanium powder had particles smaller than 100 mesh (150 microns). All mixing and handling of the powders were done in a glove box purged with purified nitrogen. The powders were milled for 30 hours and then removed from the vial. The powder had a calculated formula of $NiTi_2$.

Second, 18.117 grams of the $NiTi_2$ amorphous matrix material was mixed with 6.883 grams of crystalline nickel powder (99.6% nickel) which were mechanically alloyed under the same conditions as about for 1 hour. The resultant substantially amorphous NiTi powder mixture was hot pressed into a disc at 350° C. and 10,000 atmospheres. The resultant disc was heat treated at 420° C. for 1 hour. X-ray analysis showed that the consolidated article was more than 98% amorphous.

EXAMPLE II

A bulk SmCo amorphous metal alloy article was prepared as follows. First, an amorphous $Sm_2Co$ matrix material was prepared by placing 2.831 g of Co, 14.369 g of Sm, and 5 ml of toluene in a stainless steel container with 60 g of steel balls. The powders were milled (mechanically alloyed) for 30 hours to produce a mixture with a calculated composition of $Sm_2Co$. Second, 17.2 g of $Sm_2Co$ were mixed with 2.831 g of Co and mechanically alloyed under the same conditions as above for 2 hours. The mechanically alloyed powder mixture was hot pressed into a disc at 10,000 atmospheres and 350° C. The resultant bulk SmCo amorphous metal alloy disc had a density of over 98% of its theoretical density and had less than 5% crystalline material. Finally, the SmCo disc was heat treated at 420° C. for 1 hour.

EXAMPLE III

The NiTi disc of Example I was heated at a temperature of 600° C. for one-half hour and produced a crystalline disc.

I claim as my invention:

1. A method for producing a bulk amorphous metal alloy article comprising:
   (a) mechanically alloying an amorphous matrix material, said material containing at least one metal, and at least one crystalline element which is a fast diffuser in the amorphous matrix material to give a powder mixture which is at least 50% but less than 100% amorphous; and
   (b) forming the powder mixture into a bulk amorphous metal alloy article, having a density of at least 80% of its theoretical density, at a pressure greater than 5,000 atmospheres and a temperature from about 25° C. to below the glass transition temperature of the powder mixture, and recovering the bulk amorphous metal alloy article.

2. The method of claim 1 further characterized in that said bulk amorphous metal alloy article is subsequently heat treated at a temperature above the forming temperature of claim 1 but below the glass transition temperature of the bulk amorphous metal alloy article.

3. The method of claim 1 where said bulk amorphous metal alloy article is subsequently heat treated at a temperature above its glass transition temperature for a time from about 30 to about 300 minutes to provide a bulk crystalline metal alloy article.

4. The method of claim 1 where the amorphous matrix material is a mixture of at least two metals, at least one metal selected from the group consisting of scandium, yttrium, titanium, zirconium, hafnium, vanadium, niobium, tantalum, the lanthanides and the actinides, and at least one metal selected from the group consisting of vanadium, chromium, manganese, iron, cobalt, nickel, copper, zinc, and gold.

5. The method of claim 1 where the amorphous matrix material is a mixture of at least one metal selected from the group consisting of scandium, yttrium, titanium, zirconium, hafnium, niobium, tantalum, the lanthanides, the actinides, vanadium, chromium, manganese, iron, cobalt, nickel, copper, zinc and gold and a dopant selected from the group consisting of boron, carbon and silicon.

6. The method of claim 1 where said crystalline element is selected from the group consisting of vanadium, chromium, manganese, iron, cobalt, nickel, copper, zinc, boron, carbon, silicon and gold.

7. The method of claim 1 where said forming is accomplished by extruding said mixture through an extrusion die.

8. The method of claim 1 where said forming is accomplished by hot pressing said mixture.

9. The method of claim 1 where said forming is accomplished by hot rolling said mixture.

10. The method of claim 1 wherein the forming takes place in a receptacle of a device in which the bulk amorphous metal alloy article of claim 1 is to be used.

11. The method of claim 1 where said mechanical alloying is carried out for a time in the range of about 15 minutes to about 500 hours.

* * * * *